United States Patent [19]

Rathbun

[11] Patent Number: 4,506,883

[45] Date of Patent: Mar. 26, 1985

[54] HARNESS APPARATUS AND METHOD FOR BREATHING EXERCISES

[75] Inventor: Ethan M. Rathbun, Colorado Springs, Colo.

[73] Assignee: William A. Dye, Colorado Springs, Colo. ; a part interest

[21] Appl. No.: 464,644

[22] Filed: Feb. 7, 1983

[51] Int. Cl.[3] ..... A01B 23/00

[52] U.S. Cl. ..... 272/99; 434/247; 272/143

[58] Field of Search ..... 272/99, 139, 143, 70.70 A; 128/28; 434/247

[56] References Cited

U.S. PATENT DOCUMENTS

| | | | |
|---|---|---|---|
| 1,055,267 | 3/1913 | Gibson | 272/99 |
| 1,074,846 | 10/1913 | Dickman | 272/99 X |
| 1,647,299 | 11/1927 | Konig | 272/143 |
| 2,097,376 | 10/1937 | Marshman | 272/139 |
| 2,960,180 | 11/1960 | Wachtel | 182/3 |
| 3,021,838 | 2/1962 | Fine | 128/DIG. 15 |
| 3,063,718 | 11/1962 | Steinkamp | 273/DIG. 30 |
| 3,322,102 | 5/1967 | Windle | 119/96 |
| 3,424,134 | 1/1969 | Rosenblum | 119/96 |
| 3,819,177 | 6/1974 | Spiro | 128/DIG. 15 |
| 4,197,816 | 4/1980 | Lusch | 119/96 |
| 4,303,041 | 12/1981 | Thompson et al. | 119/96 |

*Primary Examiner*—Richard J. Johnson
*Attorney, Agent, or Firm*—Young & Martin

[57] ABSTRACT

A training harness and method for training a person in proper breathing techniques employs a pair of spaced apart flexible straps adapted to encircle the torso of the human body. A plurality of relatively stiff, yet resilient support straps extend between the flexible straps to maintain the flexible straps in spaced relation to one another. The free ends of each flexible strap are provided with mating fasteners to releasably secure the free ends together so that each strap forms a closed loop, and the flexible straps are adjustable in circumferential length. The support straps are releasably secured to each flexible strap by means of fasteners and the support straps are adjustable in length to permit selected adjustment of the distance between the flexible straps. The method includes the steps of securing the first and second flexible straps around the upper and lower torso, respectively, expanding the first strap, having the person inhale a deep breath and snugly fastening the first strap into the expanded position around the upper torso. The method then includes the final step of having the person maintain expanding pressure on the first strap while continuing to breathe.

19 Claims, 8 Drawing Figures

HARNESS APPARATUS AND METHOD FOR BREATHING EXERCISES

BACKGROUND OF THE INVENTION

The present invention relates to a training harness apparatus and method used in conjunction with breathing exercises, and specifically, as an aid in teaching persons in proper breathing techniques. As is well known, proper breathing and breath control is essential for persons engaged in singing, athletics, speaking, and many other activities. Indeed, proper breathing and breath control enhances a person's general health and has an important effect on a person's posture.

It is generally understood that proper breathing encompasses diaphragmatic as opposed to accessory or "chest" breathing. To understand this, it is important to realize that the diaphragm and the abdominal muscles of a person push the lower ribs of the rib cage outward and upward while the dorsal muscles and those extending downward from a person's thorax pull the ribs from the outside. Diaphragmatic breathing fills the lower part of the lungs whereas chest breathing fills only the upper part of the lungs. Diaphragmatic breathing is more healthy since the lower part of the lungs include the greater portion of air cells while the upper part of the lungs do not have as many air cells. Further, the diaphragm, when utilized, aids in circulation by drawing blood back to the heart and also massages and stimulates the organs of the abdominal cavity.

Unfortunately, many people predominantly employ accessory breathing, which is more shallow, and, since accessory breathing does not utilize the diaphragm, this muscle looses its strength. This weakened condition causes the person to be more susceptible to various respiratory infections and disabilities. Accessory breathing tends to cause unnecessary tension in the body and, conversely, diaphragmatic breathing tends to eliminate this tension. Indeed, many stress-control exercises, such as yoga and the like, emphasize proper diaphragmatic breathing as a form of relaxation, as an aid to sleep, and as a practice of general health.

Despite the advantages of diaphragmatic breathing, however, many people find it difficult to practice diaphragmatic breathing and to perceive the difference between diaphragmatic breathing and exaggerated accessory breathing. Accordingly, it is desirable to have a method for helping train people in proper breathing exercises, and more particularly, it is desirable to provide a mechanical aid to help people in these exercises.

SUMMARY OF THE INVENTION

Accordingly, it is an object of the present invention to provide a novel and useful apparatus adapted for use in training people in proper breathing exercises.

A further object of the present invention is to provide a simple and inexpensive training harness adapted to be worn by a person to help the person detect when he is engaged in diaphragmatic breathing rather than accessory breathing.

A still further object of the present invention is to provide a training harness for breathing exercises that is adjustable over a range of size to accomodate persons having different sized torsos and waists.

It is still a further object of the present invention to provide a novel and useful method for training a person in proper breathing techniques.

To accomplish these objects, the present invention defines a training apparatus broadly including a pair of adjustable flexible straps. One of these straps is adapted to extend around the upper torso of the human body, and the other of these straps is adapted to extend around the lower torso or waist area of the human body. Each of the flexible straps have free ends which may be overlapped and adjustably interconnected to one another to accommodate different sized torsos and waists. The free ends have indicia to enable measurement of the circumference of the upper and lower torso. A plurality of resilient straps extend between the two flexible straps at generally equiangularly-spaced locations when the flexible straps are secured as closed loops around the torso. The resilient straps operate to resiliently hold the two flexible straps a spaced distance from one another, which is significant when the straps are worn in training exercises. Preferably, the distance between the two flexible straps is adjustable, and, in the preferred embodiment of the present invention, this is accomplished by providing releasable attachment fasteners interconnecting the resilient straps to the flexible straps. Preferably, the releasable attachment fasteners are hook-and-loop fasteners known as "Velcro." A first strip of Velcro is provided on at least one end portion of each resilient strap, and second mating Velcro strips are located at spaced intervals around the flexible strap which corresponds to that end portion of the resilient straps which carries the first Velcro strips. Preferably, Velcro strips are provided at each end portion of each resilient strap, and both flexible straps are provided with mating Velcro strips at spaced intervals along their length. Each flexible strap is adjustable for different circumferential lengths, and this may preferably be provided by mating Velcro strips on the free ends of each flexible strap. While Velcro strips are used in the preferred embodiment, other fasteners are contemplated in alternate embodiments of this invention.

In the preferred method according to the present invention, a person is instructed in proper diaphragmatic breathing techniques by snugly securing an adjustably expandable flexible strap around the upper torso of the body and by securing a second adjustably expandable flexible strap around the lower torso of the body. The first strap is then expanded, and the person inhales a deep breath to swell the chest cavity into an expanded state. While the chest is in this expanded state, the first strap is secured into a new position that snugly embraces the expanded upper torso. The person then continues to breathe while maintaining pressure on the first strap.

These and other objects, advantages, and features of the present invention will become more readily appreciated and understood when taken together with the following detailed description in conjunction with the accompanying drawings, in which:

DETAILED DESCRIPTION OF THE PREFERRED EMBODIMENT

The present invention relates to an apparatus in the form of a harness assembly adapted to be used as an aid in instructing a person in proper breathing techniques, and specifically, for use in training a person in proper diaphragmatic breathing. Accordingly, the present invention also encompasses a method of instructing a person in diaphragmatic breathing utilizing the apparatus described with respect to the preferred embodiment of the present invention.

Figure 1:
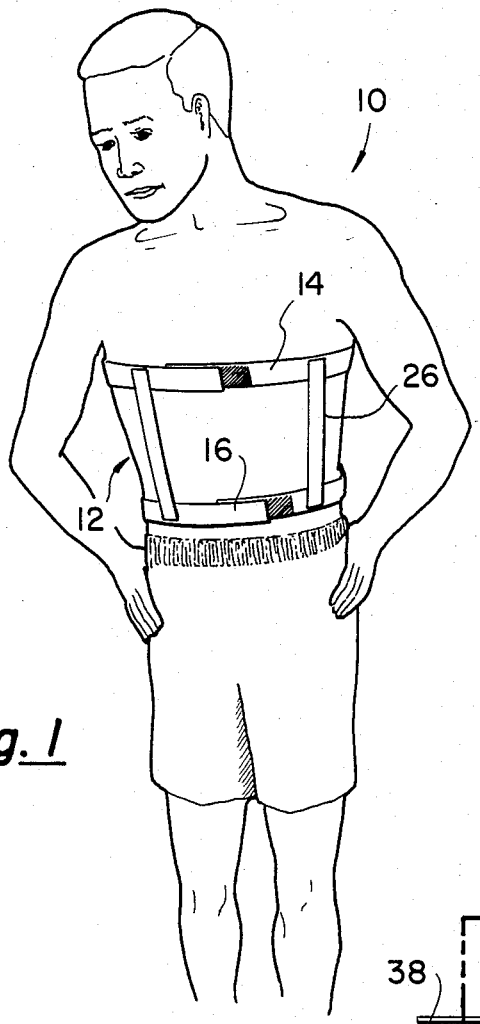
FIG. 1 is a perspective view of the preferred embodiment of the present invention being worn by an individual.
Figure 2:
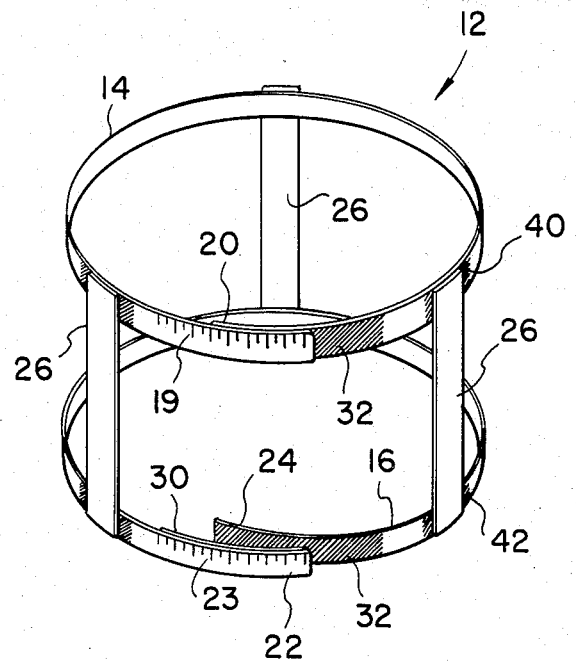
FIG. 2 is a perspective view of the preferred embodiment of the present invention shown having the free ends of the flexible straps secured to one another and the flexible straps connected to the resilient straps.
Figure 3:
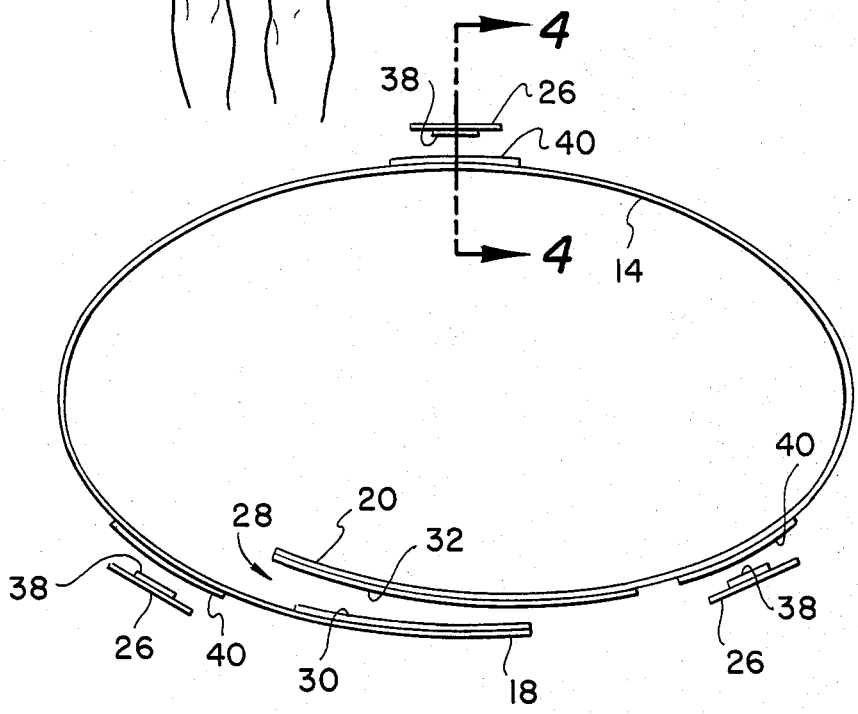
FIG. 3 is a top plan view of the training harness shown in FIG. 2 but with the free ends of the upper flexible strap being disconnected and showing the resilient straps being disconnected from the flexible strap.
Figure 4:
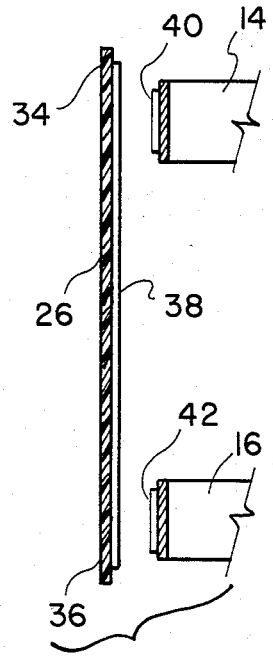
FIG. 4 is a cross-sectional view taken about line 4—4 of FIG. 3.

As is shown in FIG. 1, a person 10 is shown wearing training harness 12 according to the preferred embodiment of the present invention. Training harness 12 is best shown in FIGS. 2, 3 and 4 where it should be appreciated that harness 12 includes a first flexible strap 14 and a second flexible strap 16. Straps 14 and 16 are preferably formed of a cotton web belting material, but any other highly flexible, belt-like material could be used for straps 14 and 16. Flexible strap 14 has a free end 18 and a free end 20, and, correspondingly, flexible strap 16 has a free end 22 and a free end 24. Straps 14 and 16 are secured to one another by elongated straps 26 which are constructed out of a resilient material. Preferably, straps 26 are constructed of a resilient, yet flexible plastic, and straps 26 thus maintain straps 14 and 16 in spaced, generally parallel relation to one another.

Strap 14 and strap 16 can each be connected to form loops having adjustable circumferential lengths. To accomplish this, free ends 18 and 20 of flexible strap 14 and, correspondingly, free ends 22 and 24 of flexible strap 16 may be overlapped and fastened to one another. The preferred form of the present invention includes a mating fastener assembly associated with free ends 18 and 20, and a second fastening assembly associated with free ends 22 and 24. Since these two fastening assemblies are identical, it will be described with respect to strap 14 and free ends 18 and 20. Further, as is seen in FIG. 2, free end 18 has indicia 19, and free end 22 has indicia 23. Indicia 19 and 23 provide calibrations which register with free ends 20 and 24, respectively, enabling measurement of the circumferential length of the loops formed by straps 14 and 16. These measurements may be recorded by the wearer in order to log his progress resulting from use of the training harness.

Specifically, as can be seen in FIG. 3, free ends 18 and 20 are provided by a fastening assembly 28 as defined by mating hook-and-loop fastener strips, which are commonly sold under the name "Velcro". Assembly 28 includes a first strip 30 mounted on an end portion of free end 18 and second strip 32 mounted along an end portion of strap 14 adjacent free end 20. Strips 30 and 32 are mounted in any convenient manner, such as by sewing or by an adhesive, and are positioned to face one another when free ends 18 and 20 are placed in overlapping relationship. Thus, strips 30 and 32 are positioned on opposite faces of strap 14. Strips 30 and 32 releasably adhere to one another and preferably extend a sufficient distance along the end portions of strap 14 so that a degree of adjustment may be achieved by varying the amount of overlap of free ends 18 and 20. As noted, free ends 22 and 24 of strap 16 are provided with a fastening assembly similar to fastening assembly 28.

Although resilient straps 26 may be permanently affixed to straps 14 and 16, as described below, in the preferably form of the present invention, resilient straps 26 are releasably fastened to flexible straps 14 and 16. As may be best seen in FIGS. 3 and 4, each resilient strap 26 has opposite free end portions 34 and 36 which respectively attach to strips 14 and 16. To this end, one half of a coacting hook-and-loop, or "Velcro," fastener strip is provided along the entire length of each strap 26 with strip 38 adapted to releasably adhere to the other, coacting strips of this hook-and-loop fastening assembly. These coacting strips are defined by strips 40 attached to flexible strap 14 and strips 42 attached to flexible strap 16. In this manner, then, it should be appreciated that the distance between straps 14 and 16 may be selectively adjusted along resilient straps 26 so as to accomodate persons of different torso length. In other words, the effective length of each of straps 26 as measure between straps 14 and 16 is selectively adjustable.

Strips 38, 40 and 42 may be attached to their respective straps 26, 14 and 16 in any convenient manner. It should be appreciated that, by using elongated strips 40 and 42 that extend a portion of the circumferential distance around respective straps 14 and 16, the point of attachment of strip 38 to straps 14 and 16 is circumferentially adjustable. Further, it should be understood that, while the effective length of strap 26 is preferably adjusted by strips 38, 40 and 42, other means for adjusting the length of straps that are generally known in the art are contemplated by this invention.

In assembly and use, then, a person may fasten flexible strap 14 around his upper torso, just beneath the armpits by encircling strap 14 around his torso and adhering free ends 18 and 20 to one another. Flexible strap 16 may be secured around the lower torso or waist of the person and free ends 22 and 24 may be adhered to one another to secure strap 16 in this position. Resilient straps 26 may then be secured to straps 14 and 16 by adhering strips 38 to respective strips 40 and 42 as is shown in FIG. 2. In the event that an excess length of resilient straps 26 extends beyond straps 14 and 16, the excess may, if desired, be removed, simply by cutting each of resilient straps 26 to the desired length.

Figure 5:
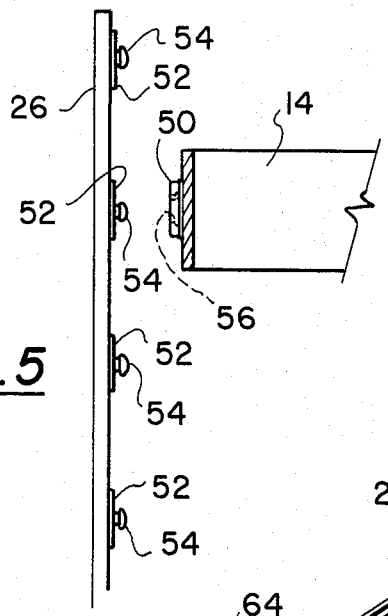
FIG. 5 is a side view in partial cross section showing an alternate positionably adjustable fastening system interconnecting the resilient straps to the flexible straps.
Figure 7:
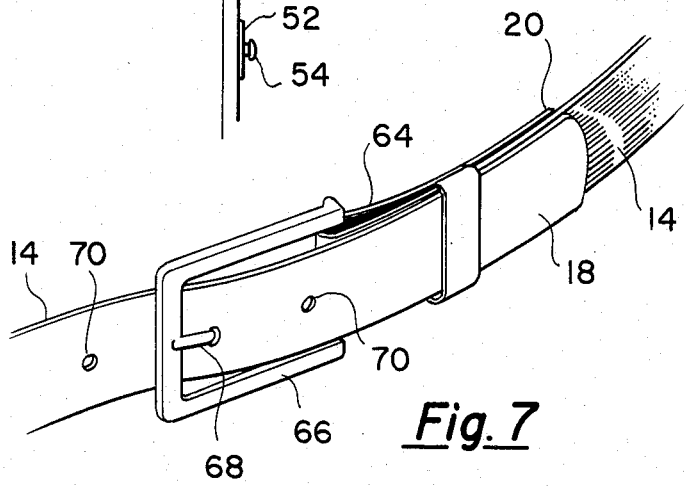
FIG. 7 shows an alternate embodiment of the fasteners securing the free ends of the flexible straps to one another.
Figure 6:
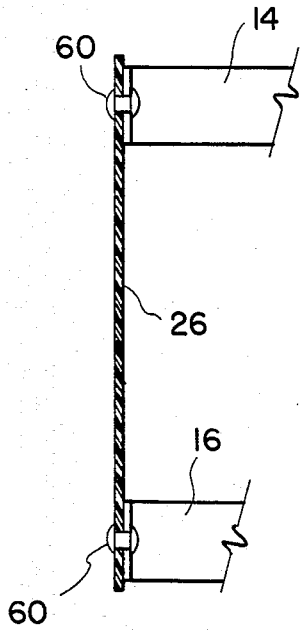
FIG. 6 is another alternate embodiment of the present invention showing a resilient strap being permanently mounted to the flexible straps.
Figure 8:
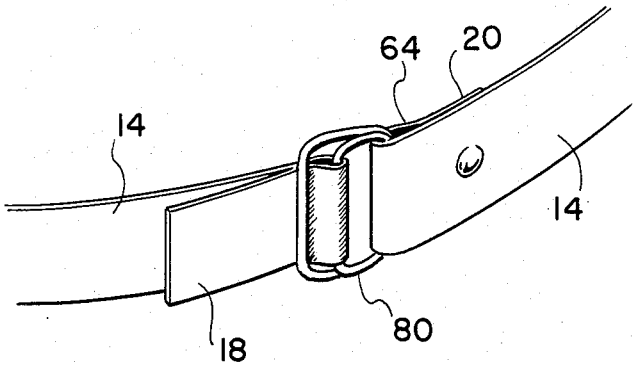
FIG. 8 is another alternate embodiment of the fasteners securing the free ends of the flexible straps to one another.

FIGS. 5 and 6 show alternate embodiments of the fastening of resilient strap 26 to flexible straps 14 and 16, and FIGS. 7 and 8 show alternate adjustable fasteners for flexible straps 14 and 16. While it should be appreciated that a description is made of the preferred embodiment of these fasteners, and a description is made of these alternate embodiments, numerous different fastening assemblies and adjustable fasteners as are known in the art may be used in the present invention without departing from the scope thereof.

Referring to FIG. 5, a releasable snap lock fastening assembly is shown for interconnecting flexible strap 14 and, correspondingly, flexible strap 16 to a resilient strap 26. Here, the fastening assembly comprises a female snap member 50 secured in any convenient manner to strap 14 and a plurality of male snap members 52 secured in any convenient manner along the length of resilient strap 26. Each male snap member 52 has an enlarged head 54 adapted to releasably engage female snap member 50. To this end, female snap member 50 includes a cavity 56, and head 64 may snap fit in cavity 56. By providing a plurality of male snap members 52 along each strap 26, strap 26 may be secured to straps 14 and 16 at a plurality of discrete positions along the length of eash resilient strap 26.

While it should be appreciated that the use of "Velcro" strips described with respect to the preferred embodiment of the present invention is advantageous in that it provides a infinite adjustability of the attachment of strap 14 and strap 16 to resilient strap 26, the use of a plurality of male members 52 provides a suitable alternative even though the adjustment is in discrete steps. The reason that the assembly shown in FIG. 5 is adequate may be understood since the exact positioning of each of the flexible straps 14 and 16 with respect to strap 26 is not highly critical.

As noted above, straps 14 and 16 may be permanently secured to resilient strap 26, and this embodiment is shown in FIG. 6. Referring to FIG. 6, it may be seen that resilient strap 26 is secured to straps 14 and 16 by means of rivets 60. It should be appreciated that strap 26 could be secured to straps 14 and 16 in any other convenient manner other than rivet 60. Further, the assembly shown in FIG. 6 is somewhat simpler in construction, and is therefore advantageous in this respect. However, by permanently securing resilient strap 26 to flexible straps 14 and 16, the user loses the advantage of having an adjustability in the distance between straps 14 and 16. Where the user has determined an acceptable size and distance between straps 14 and 16, though, a permanent attachment is quite adequate.

As noted above, free ends 18 and 20 may be secured to one another in any convenient manner, and, similarly, free ends 22 and 26 of flexible strap 16 may be releasably secured to each other in any convenient manner. Referring to FIG. 7, then, a standard belt buckle assembly is shown with respect to free ends 18 and 20. Here, free end 20 has a reverse curved loop 64 which mounts a buckle 66 having a tongue 68. Free end 18 has a plurality of holes 70 adapted to receive tongue 68 in a standard manner. In FIG. 8, free end 20 terminates in a reverse curved loop 64 that supports a D-ring buckle assembly 80. Free end 18 of strap 14 may then be threaded through buckle assembly 80 so that fee ends 18 and 20 are secured together with the circumferential length of strap 14 thus being adjustable.

From the foregoing, it should be appreciated that flexible straps 14 and 16 and resilient straps 26 form a training harness that may be worn by a person, with this training harness being particularly adapted for use as an aid in teaching proper breathing techniques. To this end, the method according to the preferred embodiment of the present invention comprises the steps of snugly securing an adjustably expandable first flexible strap in a first expanded position around the upper torso of the body and snugly securing an adjustably expandable second flexible strap in a second expanded position around the lower torso of the body. The first strap is then expanded to loosen it around the upper torso of the body. The method of instructing a person in proper diaphragmatic breathing techniques then includes the step of having the person inhale a deep breath that expands the chest cavity to a volume greater than that corresponding to the first expanded position of the first flexible strap. While the person holds the breath, the first strap is secured in a third expanded position which snugly embraces the expanded upper torso of the body. Once the first strap is secured in the third expanded position, the method of instruction includes the step of having the person maintain an expanding pressure on the first strap in the third expanded position while continuing to breathe with the diaphragm. This latter step requires that the person utilize the diaphragm and the abdominal muscles since the chest is held in a fully expanded state. It should be appreciated that, when the chest cavity is expanded, the lower torso shrinks in size since the lower internal organs are pulled inwardly. Thus, the second strap becomes loose around the lower torso or waist region. The method may then include the further step of having the person expand and contract the abdominal muscles and diaphragm so that the lower torso in moved into and out of a pressure contact with the second flexible strap. When breathing while holding the upper torso in snug contact with the first flexible strap and moving the lower torso into and out of snug fitting engagement wit the second flexible strap, the person practices deep diaphragmatic breathing.

Embodiments of the present invention have been shown and described with a degree of particularity to enable a complete and full understanding of those embodiments. It should be understood, however, that the present invention involves inventive concepts defined in the appended claims, and those inventive concepts are not intended to be limited by the detailed description herein beyond that required by the prior art and as the claims are allowed, the Harness Apparatus and Method for Breathing Exercises of the present invention can take othe forms an is susceptible to various changes in detail of structure without departing from the principles of this invention.

I claim:

1. A training harness adapted for use by a person as an aid in breathing exercises, comprising:

a first flexible strap adapted to extend around the upper torso region of the human body and having first fastening means on its free ends, said first fastening means for releasably and adjustably interconnecting the free ends of said first flexible strap to define a first closed loop of selectably variable circumferential length;

a second flexible strap adapted to extend around the lower torso region of the human body and having second fastening means on its free ends, said second fastening means for releasably and adjustably interconnecting the free ends of said second flexible strap to define a second closed loop of selectably variable circumferential length; and relatively stiff, resilient support means interconnecting said first and second flexible straps for maintaining said first and second support straps in a normal state of spaced-apart relation to one another while permitting resilient deflection of said first and second flexible straps toward one another.

2. A training harness according to claim 1 wherein said resilient support means includes a plurality of resilient plastic straps, each having a first connecting means for releasably connecting a first end to said first flexible strap and a second connecting means for releaseably connecting a second end to said second flexible strap, said resilient straps being disposed at generally equally spaced distances around the circumferences of said first and second flexible straps when the free ends of the first and second flexible straps are interconnected.

3. A training harness according to claim 2 wherein each of said first and second connecting means includes adjustment means for selectively varying the length thereof measured between said first and second straps.

4. A training harness according to claim 2 including a first releasable fastener on an end portion of each said resilient strap and a second, coacting fastener corresponding to each said first releasable fastener, said coacting fasteners each being located on a respective one of said first and second flexible straps and operative to permit releasable attachment of a corresponding first fastener thereto.

5. A training harness according to claim 4 wherein said first fasteners and said second fasteners being hook-and-loop fastening assemblies.

6. A training harness according to claim 4 including a plurality of said first fasteners along the said end portion of each resilient strap whereby the point of attachment of each said resilient strap to a respective one of said first and second flexible straps may be selectively varied among a plurality of discrete locations.

7. A training harness according to claim 2 including a first set of releasable fasteners, said first set having a first coacting member on one end portion of each said resilient strap, and second coacting members each corresponding to a respective first coacting member and located on said first flexible strap, and a second set of releasable fasteners, said second set having a third coacting member on the other end portion of each said resilient strap and fourth coacting members each corresponding to a respective third coacting member and located on said second flexible strap, said first and second coacting members being mating hook-and-loop fastener strips and said third and fourth coacting members being mating hook-and-loop fasteners strips, said first and second sets of releasable fasteners being operative to permit continuous releasable and adjustable attachment of the end portions of said resilient straps to said first and second flexible straps.

8. A training harness according to claim 7 wherein said first and third coacting members on each said resilient strap being defined by a continuous hook-and-loop fastener strip.

9. A training harness according to claim 7 including a plurality of first coacting members on each said resilient strap.

10. A training harness according to claim 7 including a plurality of third coacting members on each said resilient strap.

11. A training harness according to claim 1 wherein said first and second fastening means includes hook-and-loop fastener strips.

12. A training harness according to claim 1 wherein the free ends of each of said first and second flexible straps have indicia corresponding to the circumferential length of each said flexible strap when its free ends are secured to one another.

13. A training harness adapted for use by a person as an aid in diaphragm breathing exercises, comprising:

a first flexible strap having first free ends and adapted to extend around the upper torso of the body;

a second flexible strap having second free ends and adapted to extend around the lower torso of the body;

a plurality of support straps, each having a first strap end adapted to be releasably secured to said first flexible strap and a second strap end adapted to be secured to said second flexible strap and operative to maintain said first and second flexible straps at a spaced distance from one another;

first adjustable fastening means on said first free ends for releasably and adjustably securing said first free ends together whereby said first flexible strap defines a first closed loop of adjustable length;

second adjustable fastening means on said second free ends for releasably and adjustably securing said free ends together whereby said second flexible strap defines a second closed loop of adjustable length; and adjustable attachment means associated with each of said first and second strap ends of each said support strap for securing each said strap end to a respective flexible strap and for selectively varying the length of said support straps as measured between said first and second flexible straps.

14. A training harness according to claim 13 wherein each said adjustment means includes a hook-and-loop fastener assembly, each said hook-and-loop fastener assembly having a first mating member secured to one of said first and second flexible straps and a coacting second mating member secured to the respective support strap.

15. Training harness according to claim 14 wherein each said support strap is constructed of a relatively stiff but resilient material, each said second mating member being an elongated hook-and-loop fastener strip mounted along one face of its respective support strap.

16. Training harness according to claim 15 wherein each said second mating member extends along substantially the entire length of its respective support strap, and including a pair of first mating members corresponding to each said support strap, one member of each pair being mounted on said first flexible strap and the other member of each pair being mounted on said second flexible strap.

17. Training harness according to claim 13 wherein said first and second adjustable fastening means each is defined by a mating pair of elongated hook-and-loop fastener strips, one member of each pair being mounted on one free end of its associated flexible strap and the other member of each pair being mounted on the other free end of its associated flexible strap in facing relation to the said one member when said free ends are overlapped.

18. The method of instructing a person in proper diaphragmatic breathing techniques comprising the steps of:

snugly securing an adjustably expandable first flexible strap in a first expanded position around the upper torso of the body;

snugly securing an adjustably expandable second flexible strap in a second expanded position around the lower torso of the body.

expanding the first strap;

having the person inhale a deep breath to expand the chest cavity and securing said first strap in a third expanded position snugly embracing the upper torso of the body; and having the person maintain expanding pressure on said first strap in said third expanded position while continuing to breathe with the diaphragm.

19. The method according to claim 18 further including the step of having the person breathe by expanding and contracting the lower torso into and out of snug fitting engagement with said second flexible strap.

* * * * *